US009618875B2

(12) United States Patent
Yamaguchi et al.

(10) Patent No.: US 9,618,875 B2
(45) Date of Patent: Apr. 11, 2017

(54) OPTICAL WRITING CONTROL DEVICE, IMAGE FORMING APPARATUS, AND METHOD OF CONTROLLING OPTICAL WRITING DEVICE

(71) Applicants: Akinori Yamaguchi, Ikeda (JP); Masayuki Hayashi, Toyonaka (JP); Motohiro Kawanabe, Osaka (JP); Yoshinori Shirasaki, Toyonaka (JP); Yuusuke Kohri, Ikeda (JP); Masatoshi Murakami, Ikeda (JP)

(72) Inventors: Akinori Yamaguchi, Ikeda (JP); Masayuki Hayashi, Toyonaka (JP); Motohiro Kawanabe, Osaka (JP); Yoshinori Shirasaki, Toyonaka (JP); Yuusuke Kohri, Ikeda (JP); Masatoshi Murakami, Ikeda (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/856,216

(22) Filed: Sep. 16, 2015

(65) Prior Publication Data

US 2016/0077461 A1 Mar. 17, 2016

(30) Foreign Application Priority Data

Sep. 17, 2014 (JP) ..... 2014-188437

(51) Int. Cl.
*G03G 15/04* (2006.01)
*G03G 15/043* (2006.01)

(52) U.S. Cl.
CPC ..... *G03G 15/043* (2013.01); *G03G 15/04054* (2013.01)

(58) Field of Classification Search
None
See application file for complete search history.

(56) References Cited

U.S. PATENT DOCUMENTS 7,999,837 B2 8/2011 Tsujino
9,104,127 B2 8/2015 Yamaguchi et al.
(Continued)

FOREIGN PATENT DOCUMENTS

JP 9-174937 7/1997
JP 11-58814 3/1999
(Continued)

*Primary Examiner* — David Gray
*Assistant Examiner* — Thomas Giampaolo, II
(74) *Attorney, Agent, or Firm* — Oblon, McClelland, Maier & Neustadt, L.L.P.

(57) ABSTRACT

An optical writing control device and method are provided, for controlling light emission of a plurality of light sources to form an electrostatic latent image on a photosensitive element, the light sources including a plurality of light emitting elements disposed in a line and classified into a plurality of groups, including frequency converter circuitry configured to acquire image information to be formed as the electrostatic latent image; and a light source controller configured to control the plurality of light sources based on pixel information generated from the acquired image information, wherein the light source controller is further configured to control the light emission of the plurality of light sources by classifying the light emitting elements into the plurality of groups, and shifting a timing of light emission from one group of the plurality of groups to a next group of the plurality of groups, and determine a common illuminating period for the light emitting elements of at least one light source of the plurality of light sources based on the shifted timing of light emission among the plurality of groups.

8 Claims, 11 Drawing Sheets

(56) References Cited

U.S. PATENT DOCUMENTS

| | | | | |
|---|---|---|---|---|
| 2007/0210997 | A1* | 9/2007 | Kasai | B41J 2/45 345/82 |
| 2011/0064431 | A1 | 3/2011 | Kohri et al. | |
| 2011/0228438 | A1 | 9/2011 | Kohri et al. | |
| 2011/0292418 | A1* | 12/2011 | Hashimoto | G03G 15/011 358/1.9 |
| 2012/0057889 | A1 | 3/2012 | Yamaguchi et al. | |
| 2013/0063130 | A1 | 3/2013 | Kohri | |
| 2013/0242318 | A1 | 9/2013 | Yamaguchi et al. | |
| 2014/0035367 | A1 | 2/2014 | Kohri | |
| 2014/0139607 | A1 | 5/2014 | Hayashi | |
| 2015/0125167 | A1 | 5/2015 | Yamaguchi et al. | |

FOREIGN PATENT DOCUMENTS

| | | |
|---|---|---|
| JP | 2009-113204 | 5/2009 |
| JP | 2010-173226 | 8/2010 |
| JP | 2013-109295 | 6/2013 |

* cited by examiner

OPTICAL WRITING CONTROL DEVICE, IMAGE FORMING APPARATUS, AND METHOD OF CONTROLLING OPTICAL WRITING DEVICE

CROSS-REFERENCE TO RELATED APPLICATIONS

The present application claims priority to and incorporates by reference the entire contents of Japanese Patent Application No. 2014-188437 filed in Japan on Sep. 17, 2014.

BACKGROUND

1. Technical Field

The present invention relates to an optical writing control device, an image forming apparatus, and a method of controlling an optical writing device.

2. Description of the Related Art

In recent years, there has been a trend to promote the digitization of information. Image processing apparatuses such as printers and facsimiles that are used to output digitized information and scanners used to digitize documents have become indispensable.

In many cases, such an image processing apparatus is configured as a multifunction peripheral that can be used as a printer, a facsimile, a scanner, and a copying machine by including an image capture function, an image forming function, a communication function, and the like.

Among such image processing apparatuses, an electrophotographic image forming apparatus is widely used to output digitized documents. The electro-photographic image forming apparatus exposes a photosensitive element to form an electrostatic latent image. Then, the apparatus develops the electrostatic latent image with developer such as toner to form a toner image. Finally, the apparatus transfers the toner image onto a piece of paper to output the paper.

For an electro-photographic image forming apparatus, a linear light source such as an LEDA (Light Emitting Diode Array) may be used. The LEDA includes a plurality of LEDs (Light Emitting Diodes), which are arranged in a line along a main scanning direction as a light source to expose the photosensitive element. In such a linear light source, the diodes are classified into certain number of groups, and each group is subject to emission control, such as time-division emission control.

By applying such time-division control, the apparatus can reduce electric power required to illuminate the diodes, compared to simultaneous control, which illuminates all diodes simultaneously. On the other hand, an exposure position for each diode varies along with rotation of the photosensitive element, since the plurality of diodes are arranged in parallel to the rotation axis of the photosensitive element.

In a conventional technology, it is known to reduce total illumination period of all LED elements within a half of one line cycle. Moreover, it is also known to shift image data to correct misalignment due to the time-division control.

A typical full-color image forming apparatus has a plurality of image forming units. For example, a full color image forming apparatus includes four image forming units for CMYK (Cyan, Magenta, Yellow and Black). Necessary exposure time is different because of the material of photoconductive drums, toners, etc. As a result, the illuminating cycle might become different for each color during in the time-division control. Such difference of exposure times causes misalignment between each of the colors. Therefore, there is a need to prevent misalignment in one image forming unit, and to prevent the misalignment in the plurality of image forming units, by the time-division control.

SUMMARY

The disclosed embodiments provide an optical writing control device. The optical writing control device that controls light emission of a plurality of light sources to form an electrostatic latent image on a photosensitive element, the light sources including a plurality of light emitting elements disposed in a line and classified into a plurality of groups, comprising: frequency converter circuitry configured to acquire image information to be formed as the electrostatic latent image; and a light source controller configured to control the plurality of light sources based on pixel information generated from the acquired image information, wherein the light source controller is further configured to control the light emission of the plurality of light sources by classifying the light emitting elements into the plurality of groups, and shifting a timing of light emission from one group of the plurality of groups to a next group of the plurality of groups , and determine a common illuminating period for the light emitting elements of at least one light source of the plurality of light sources based on the shifted timing of light emission among the plurality of groups.

The disclosed embodiments also provide an optical writing control method for controlling light emission of a plurality of light sources to form an electrostatic latent image on a photosensitive element, the light sources include a plurality of light emitting elements disposed in a main scanning line and classified into a plurality of groups, the method comprising: acquiring, using frequency converter circuitry, image information to be formed as the electrostatic latent image; controlling the plurality of light sources based on pixel information generated from the acquired image information, by controlling the light emitting elements in every group of the plurality of groups in turn, thereby exposing the photosensitive element in a sub-scanning line of the main scanning line; and determining a common illuminating period for the light emitting elements of at least one light source of the plurality of light sources based on the shifted timing of light emission among the plurality of groups.

The light source controller determines the common illuminating period by acquiring the each illuminating period of each of the light sources. The common illuminating period is set to the longest value among the shortest values for each illuminating period of an individual light emitting element among the plurality of light sources.

The plurality of light sources are disposed in a line and the plurality of light sources correspond to an main scanning line. Otherwise, the plurality of light sources are arranged to a plurality of image forming units, the plurality of image forming units form a full-color image.

DETAILED DESCRIPTION OF THE PREFERRED EMBODIMENTS

Hereinafter, embodiments will be described in detail with reference to the drawings. In the described embodiments, an image forming apparatus may be a multifunction peripheral (MFP) as an example. The image forming apparatus includes a linear light source, in which a plurality of light emitting elements are arranged in a line along a main-scanning direction, as a light source to expose a photosensitive element.

Consistent with an embodiment, time-division control is performed to drive the illuminant bodies. The illuminant bodies are classified into one of a plurality of groups, and illuminant bodies in a same group are driven. Then illuminant bodies in next group are driven. In such manner, the time-division control is achieved. In such time-division control, accuracy of positions for exposing the photosensitive element should be increased.

Figure 1:
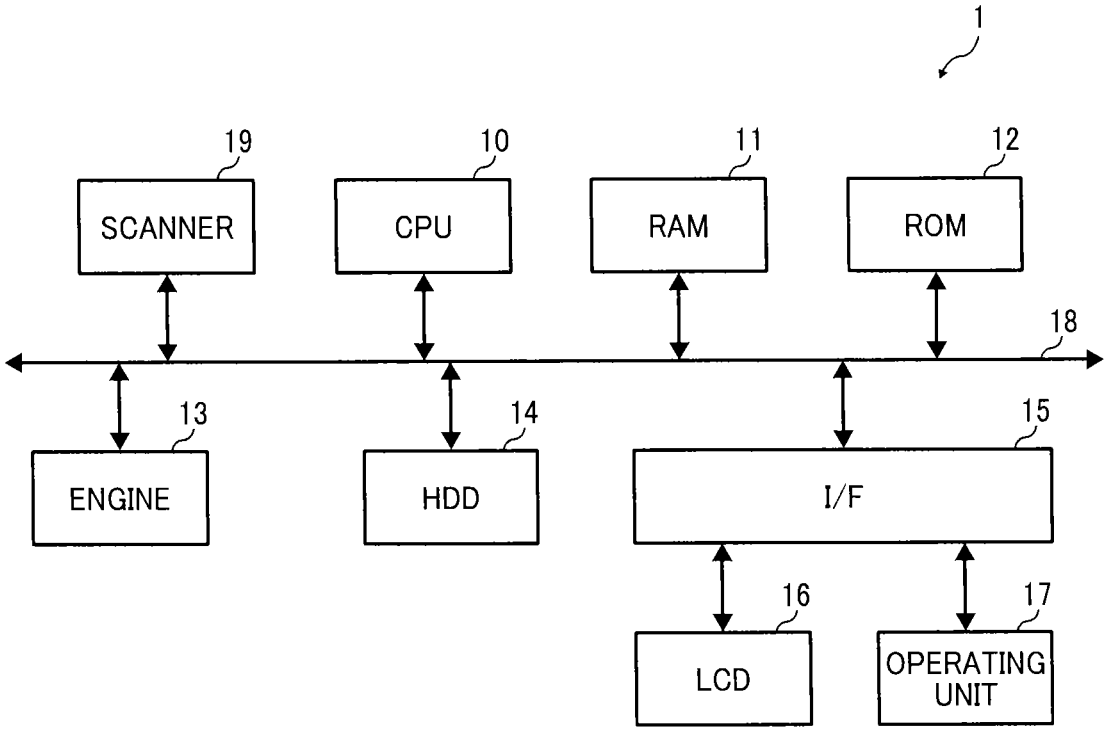
FIG. 1 is a block diagram illustrating a hardware configuration of an image forming apparatus according to an embodiment.

FIG. 1 is a block diagram illustrating a hardware configuration of an image forming apparatus according to an embodiment. In FIG. 1, the image forming apparatus is configured as an MFP having, for example, a scanner 19 and a print engine 13.

As illustrated in FIG. 1, the image forming apparatus 1 includes an engine 13 that forms an image in addition to a similar configuration of an information processing terminal such as a general server or PC (Personal Computer). Further, the image forming apparatus 1 includes a scanner 19 that acquires scanned image data. In other words, in the image forming apparatus 1, a CPU (Central Processing Unit) 10, a RAM (Random Access Memory) 11, a ROM (Read Only Memory) 12, an engine 13, an HDD (Hard Disk Drive) 14, and an interface (I/F) 15 are connected via a bus 18. The I/F 15 is connected to a LCD (Liquid Crystal Display) 16 and operating unit 17. Moreover, in the image forming apparatus 1, scanner 19 is also connected to the bus 18.

The CPU 10 is a computing unit that controls the operation of the image forming apparatus 1. The RAM 11 may be a volatile storage medium that allows information to be read and written, and is used as a work area when the CPU 10 processes information. The ROM 12 may be a non-volatile storage medium for read only of stored programs of firmware and the like. The engine 13 is a hardware mechanism to actually form an image in the image forming apparatus 1.

The HDD 14 is a non-volatile storage medium that allows information to be read and written, in which an Operating System (OS), and various control programs, application programs, and the like, are stored. The I/F 15 connects the bus 18 to various types of hardware, networks, and the like, and controls them. The LCD 16 is a visual user interface that allows a user to check the state of the image forming apparatus 1. The operating unit 17 is a user interface, such as touch keys and/or hard keys that allows the user to input information into the image forming apparatus 1.

In such a hardware configuration, programs stored in recording media such as the ROM 12, the HDD 14, or an optical disc (not shown) are read out to the RAM 11. The CPU 10 performs computations in accordance with these programs to configure a software control unit. A combination of the software control unit configured in this manner and the hardware operates to realize the functions of the image forming apparatus 1 according to an embodiment.

Figure 2:
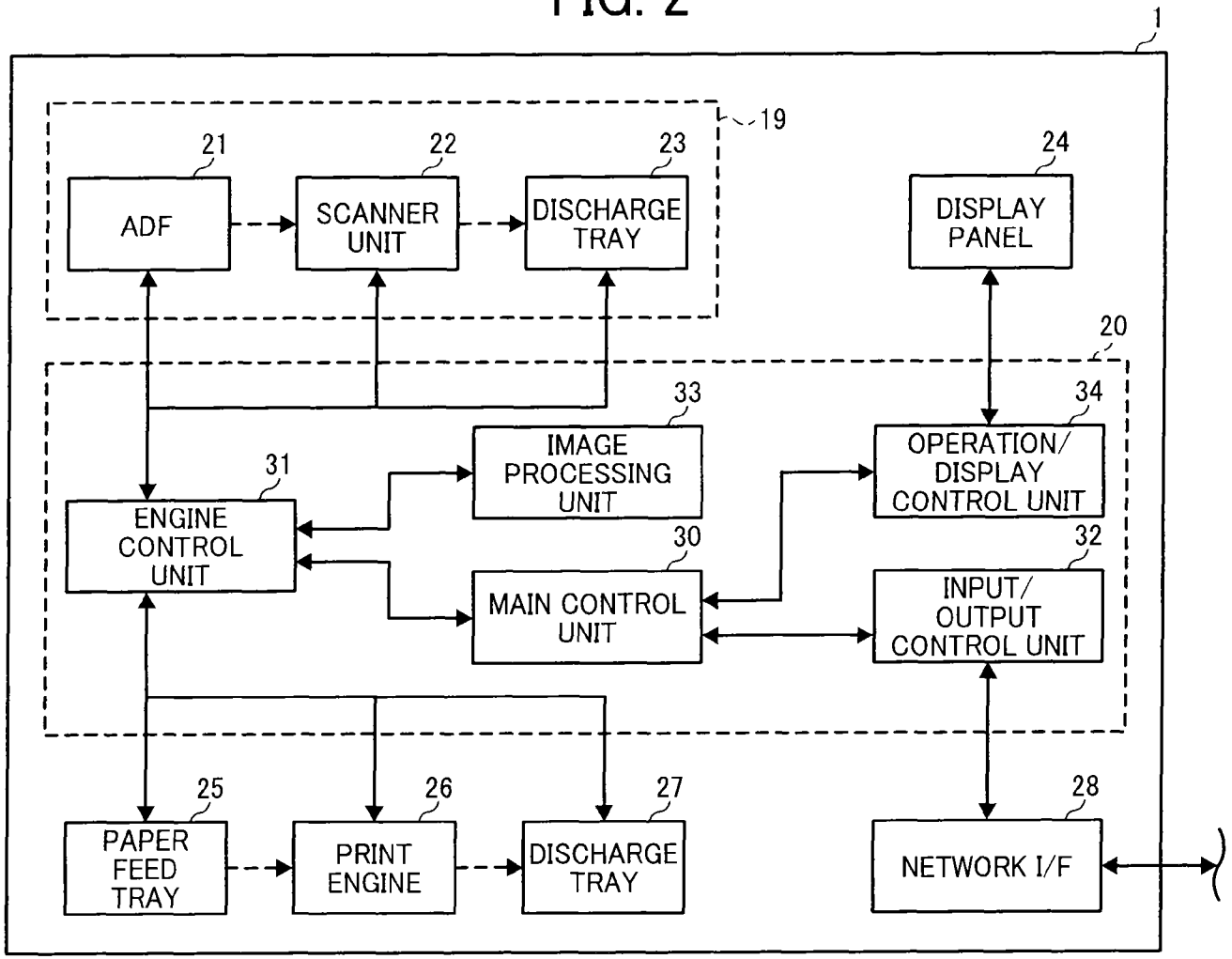
FIG. 2 is a block diagram illustrating a functional configuration of the image forming apparatus according to an embodiment.

Next, a functional configuration of the image forming apparatus 1 according to an embodiment will be described with reference to FIG. 2. FIG. 2 is a block diagram illustrating a functional configuration of the image forming apparatus 1. As illustrated in FIG. 2, the image forming apparatus 1 includes a controller 20, an Auto Document Feeder (ADF) 21, a scanner unit 22, a discharge tray 23, a display panel 24, a paper feed tray 25, a print engine 26, a discharge tray 27, and a network I/F 28.

In FIG. 2, the ADF 21, the scanner unit 22, and the discharge tray 23 correspond to the scanner 19 in FIG. 1. Moreover, in FIG. 2, the print engine 26 corresponds to the engine 13 in FIG. 1.

The controller 20 includes a main control unit 30, an engine control unit 31, an input/output control unit 32, an image processing unit 33, and an operation/display control unit 34. In FIG. 2, exemplary electrical connections are illustrated by the solid arrows and the flow of paper is illustrated by the broken arrows.

The display panel 24 is an output interface to visually display the status of the image forming apparatus 1. The display panel 24 is also an input interface (operating unit) when the user directly operates the image forming apparatus 1 or inputs information into the image forming apparatus 1. The display panel 24 may be configured as touchscreen. The network I/F 28 is an interface to allow the image forming apparatus 1 to communicate with another device via a network, and uses an ethernet or Universal Serial Bus (USB) interface.

The configuration of controller 20 comprises software and hardware. Specifically, control programs of firmware and the like that are stored in the ROM 12 and a non-volatile memory, and non-volatile recording media such as the HDD 14 and an optical disc, are loaded into a memory such as the RAM 11, and the controller 20 may operate based on the computations of the CPU 10 in accordance with these programs, and on hardware such as an integrated circuit. The controller 20 functions as a control unit for controlling the image forming apparatus 1.

The engine control unit 31 drives and controls the print engine 26, the scanner unit 22, and the like. The input/output control unit 32 provides signals and instructions that are input via the network I/F 28 to the main control unit 30. Moreover, the main control unit 30 controls the input/output control unit 32, and accesses another device via the network I/F 28. The main control unit 30 controls those engine control unit 31, the input/output control unit 32, the image processing unit 33, and the operation/display control unit 34.

In response to the control of the main control unit 30, the image processing unit 33 generates image information based on print information contained in an input print job.

The image information is used by the print engine 26, as an image forming unit, to form an image in an image forming operation. The print information contained in the print job is image information converted into a format that the image forming apparatus 1 can recognize. Such conversion is performed, for example, by a printer driver installed in an information processing apparatus such as a PC. The operation/display control unit 34 displays information on the display panel 24, or notifies the main control unit 30 of information input via the display panel 24.

When the image forming apparatus 1 operates as a printer, the input/output control unit 32 first receives a print job via the network I/F 28. The input/output control unit 32 then transfers the received print job to the main control unit 30. When receiving the print job, the main control unit 30 controls the image processing unit 33 to generate image information based on print information contained in the print job.

When the image information is generated by the image processing unit 33, the engine control unit 31 controls the print engine 26 based on the generated image information to form an image on a recording medium conveyed from the paper feed tray 25. In other words, the print engine 26 functions as an image forming unit. A document on which the image has been formed by the print engine 26 is ejected into the discharge tray 27.

When the image forming apparatus 1 operates as a scanner, the operation/display control unit 34 transfers a scan execution signal to the main control unit 30 in response to a user operation. This user operation is applied at the display panel 24. The input/output control unit 32 also transfers a scan execution signal to the main control unit 30 in response to a scan execution instruction from an external PC via the network I/F 28. The main control unit 30 controls the engine control unit 31 based on the received scan execution signal. The engine control unit 31 drives the ADF 21 to convey a scanning target document set on the ADF 21 to the scanner unit 22. Then, the engine control unit 31 drives the scanner unit 22 to capture the document conveyed from the ADF 21. Moreover, if the document is not set on the ADF 21 but set directly on the scanner unit 22, the scanner unit 22 captures the set document in accordance with the control of the engine control unit 31. In other words, the scanner unit 22 operates as an image capture unit.

In the image capture operation, an image capture device such as a charge-coupled device (CCD) included in the scanner unit 22 optically scans the document, and image capture information is generated from the optically scanned information. The engine control unit 31 transfers the image capture information generated by the scanner unit 22 to the image processing unit 33. The image processing unit 33 generates image information based on the image capture information received from the engine control unit 31. The control unit 30 controls the generation of the image processing unit 33 to generate the image information. The image information generated by the image processing unit 33 is saved in the HDD 14. In other words, the scanner unit 22, the engine control unit 31, and the image processing unit 33 operate together and function as a document scanning unit.

The image information generated by the image processing unit 33 is stored in the HDD 14 as it is at the instruction of the user, or transmitted to an external device via the input/output control unit 32 and the network I/F 28.

When the image forming apparatus 1 operates as a copier, the image processing unit 33 generates image information based on the image capture information. As explained above, the image capture information is received by the engine control unit 31 from the scanner unit 22. Also, the image processing unit 33 generates image information based on the image information. The image information is generated by the image processing unit 33. As in the case of the printer operation, the engine control unit 31 drives the print engine 26 based on the image information.

Figure 3:
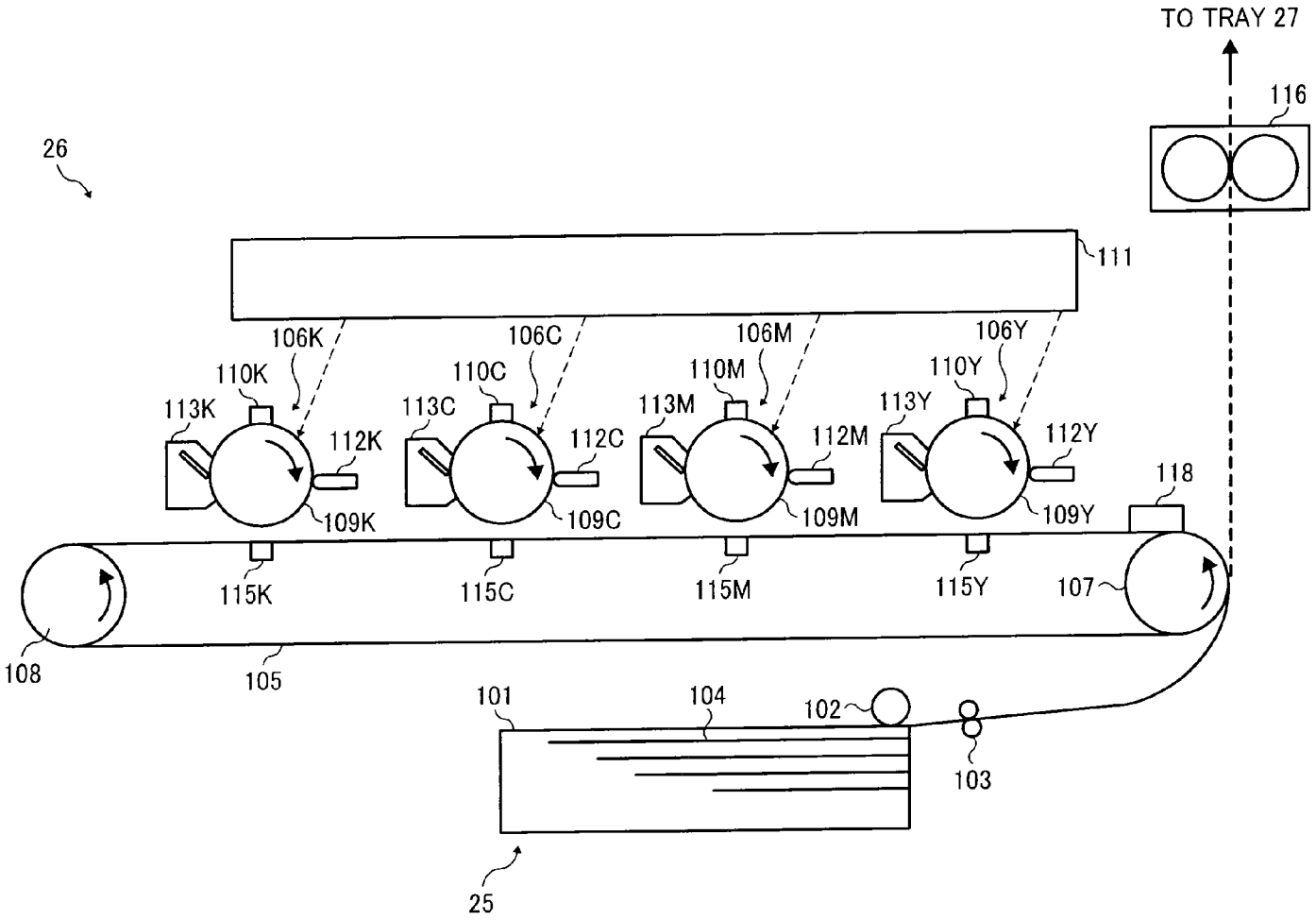
FIG. 3 is a diagram illustrating a configuration of a print engine according to an embodiment.

Next, a configuration of the print engine 26 according to an embodiment will be described with reference to FIG. 3. As illustrated in FIG. 3, in the print engine 26, a plurality of image forming units 106 (106C, 106M, 106Y, 106K) are arranged along a carriage belt 105. Such a configuration, namely a plurality of image forming units arranged along the carriage belt, is called a tandem type configuration. In the tandem type configuration, a plurality of image forming units 106Y, 106M, 106C, and 106K (hereinafter collectively referred to as the image forming unit 106) is arranged along the carriage belt 105. In an embodiment, the image forming unit 106 employs an electro photograph processing process.

The image forming unit 106 differentiates the color of a toner image to be formed and may have a common internal configuration. For example, the image forming unit 106K, the image forming unit 106M, the image forming unit 106C, and the image forming unit 106Y, form a black image, a magenta image, a cyan image, and an yellow image, respectively. In the following description, the image forming unit 106Y is specifically described, but the other image forming units 106M, 106C, and 106K are similar to the image forming unit 106Y Therefore, the reference numerals of the components of the image forming units 106M, 106C, and 106K are distinguished by M, C, and K and just displayed in the drawing instead of Y assigned to the components of the image forming unit 106Y, and their descriptions will be omitted.

The carriage belt 105 is an endless belt, in other words, an endless-shaped belt that is hung between a drive roller 107 to be rotated and driven and a driven roller 108. The drive roller 107 is rotated and driven by a drive motor (not shown). The drive motor, the drive roller 107, and the driven roller 108 function as a drive unit for moving the carriage belt 105 being the endless moving unit.

The sheet 104 is fed from the paper feed tray 25 in FIG. 2. Typically, the paper feed tray 25 has a plurality of paper trays 101. In FIG. 3, however, only one paper tray 101 is illustrated. The sheet 104 fed from the paper tray 101 stops once at a registration roller 103, and is sent out to a transfer position of an image from the carriage belt 105 at the timing of image formation at the image forming unit 106.

In an image forming process, the first image forming unit 106Y transfers a yellow toner image onto the carriage belt 105. The image forming unit 106Y includes a photosensitive drum 109Y as a photosensitive element, a charger 110Y, a developing device 112Y, a photosensitive element cleaner (not shown), and a neutralization device 113Y respectively arranged on the circumference of the photosensitive drum 109Y. An optical writing device 111 is configured so as to radiate light onto each of photosensitive drums 109Y, 109M, 109C, and 109K (hereinafter collectively referred to as the "photosensitive drum 109"). The radiated light is shown by broken arrows from the optical writing device 111 to each photosensitive drum 109. A detailed configuration of the optical writing device 111 will be explained later.

The outer surface of the photosensitive drum 109Y is evenly charged by the charger 110Y in the dark. Then, writing is performed by light from a light source of the optical writing device 111 to form an electrostatic latent image on the surface of the photosensitive drum 109Y. The light source for the photosensitive drum 109Y, for example, corresponds to a yellow image. The developing device 112Y develops the electrostatic latent image with the yellow toner, and accordingly a yellow toner image is formed on the photosensitive drum 109Y.

The yellow toner image is transferred onto the carriage belt 105 by the operation of a transfer device 115Y at a position (transfer position) where the photosensitive drum 109Y and the carriage belt 105 are in contact with each other or are closest to each other. With the transfer, an image with the yellow toner is formed on the carriage belt 105.

After the transfer has finished, unnecessary tonner remaining on the surface of the photosensitive drum 109Y is removed by a photosensitive element cleaner (not shown) part of the photosensitive drum 109Y. Then the photosensitive drum 109Y is neutralized by the neutralization device 113Y and waits for the next image formation.

As described above, the yellow toner image transferred by the image forming unit 106Y onto the carriage belt 105 is conveyed to the next image forming unit 106M by the drive of a roller of the carriage belt 105. In the image forming unit 106M, a magenta toner image is formed on the photosensitive drum 109M by a similar process to the image formation process at the image forming unit 106Y. Then, the magenta toner image is superimposed on the yellow toner image already formed.

The yellow and magenta toner image on the carriage belt 105 is conveyed to the further next image forming units 106C and 106K. A cyan toner image formed on the photosensitive drum 109C and a black toner image formed on the photosensitive drum 109K are, by a similar operation, superimposed onto the yellow and magenta toner image already transferred. In this manner, a full color intermediate transfer image is formed on the carriage belt 105. As explained above, consistent with an embodiment, the carriage belt 105 is an intermediate transfer belt.

The sheets 104 (an example of a recording medium, such as paper) are stacked in the paper tray 101. The sheets 104 are picked up sequentially from the top of the stack, by being separated by a paper feed roller 102. Then, the sheets 104 are fed to the registration roller 103. At the registration roller 103, paper conveyance timing is adjusted to transfer the intermediate transfer image onto the proper position of the sheets 104. Then, the sheets 104 are fed to the transfer position where the conveying path of the sheet is in contact with the carriage belt 105. At the transfer position, the intermediate transfer image on the carriage belt 105 is transferred onto the sheets 104. As a result, an image is formed on the sheet 104. The sheet 104 where the image has been formed thereon is further conveyed, and the image is fixed by a fixing device 116. The sheets 104 are conveyed to the paper discharge tray 27.

A belt cleaner 118 is provided to remove the toner remained on the carriage belt 105. The belt cleaner 118 is a cleaning blade pressed against the carriage belt 105 on the downstream side of the drive roller 107 and on the upstream side of the photosensitive drum 109 as illustrated in FIG. 3. The belt cleaner 118 is a developer removing unit for scraping off the toner attached to the surface of the carriage belt 105.

Figure 4:
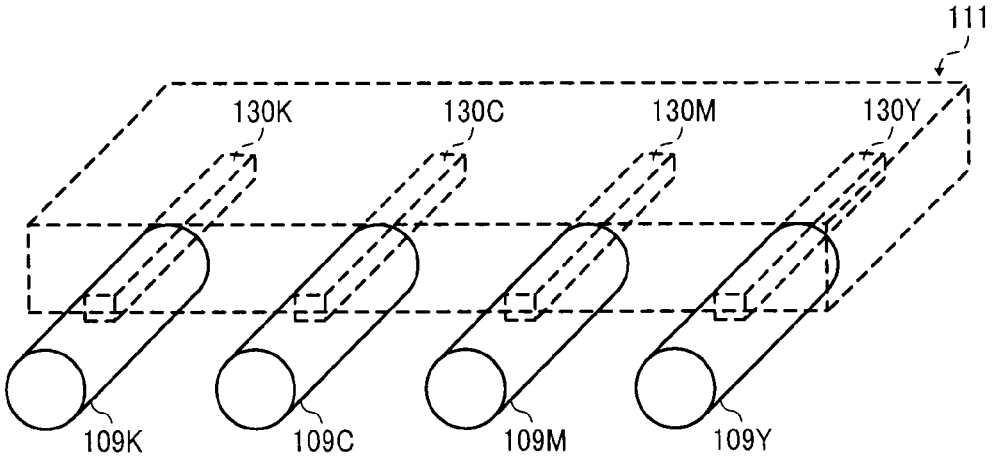
FIG. 4 is a diagram illustrating a configuration of an optical writing device according to an embodiment.

Next, the optical writing device 111 according to the embodiment will be described. FIG. 4 is a diagram illustrating an arrangement relationship of the optical writing device 111, the LEDA 130 and the photosensitive drum 109. As illustrated in FIG. 4, in the optical writing device 111, Light-Emitting Diode Array (LEDA) heads 130Y, 130M, 130C, and 130K (hereinafter collectively referred to as the LEDA head 130) are provided as light sources. The LEDA head 130Y irradiates the surface of the photosensitive drum 109Y, the LEDA head 130M irradiates the photosensitive drum 109M, the LEDA head 130C irradiates the photosensitive drum 109C, and the LEDA head 130K irradiates the photosensitive drum 109K, respectively. In FIG. 3, these LEDA head 130 are not shown for the simplicity.

Figure 5:
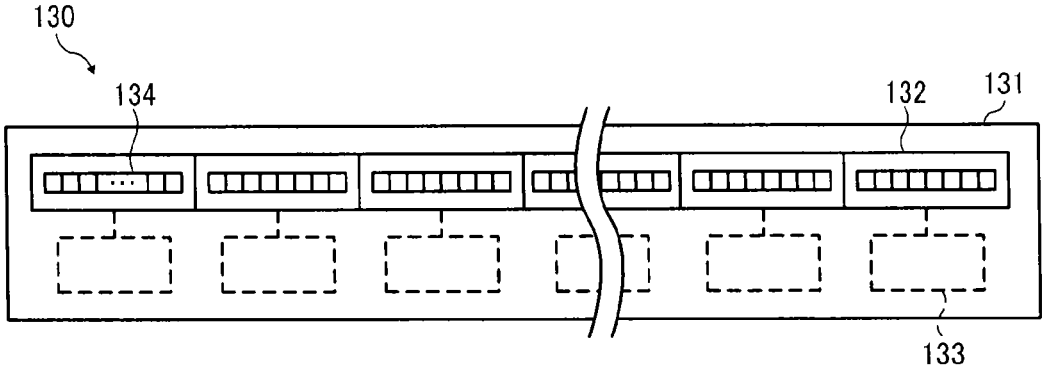
FIG. 5 is a diagram illustrating a structure of a LEDA head according to the embodiment.

Next, a structure of the LEDA head 130 according to the embodiment will be described. FIG. 5 is a diagram illustrating a structure of the LEDA head 130. FIG. 5 shows a front side view of the LEDA head 130 that faces to the photosensitive drum 109. In this embodiment, the LEDA heads 130Y, 130M, 130C, and 130K have the same configuration. Therefore, FIG. 5 shows a common structure of the LEDA head 130.

As illustrated in FIG. 5, the LEDA head 130 has a substrate 131 on which a plurality of LEDA 132 are mounted and arranged. The direction of the arrangement corresponds to the main-scanning direction of the photosensitive drum 109. In each LEDA 132, a plurality of LED elements are arranged. In an embodiment, each LED element irradiates the surface of the photosensitive element 106. Further, each LED element corresponds to each image pixel. Moreover, a plurality of driver chips 133 are also mounted on the substrate 131. The number of the driver chips 133 is the same as the number of the LEDA 132. The LEDAs 132 and the driver chips 133 are connected one-to-one, and each of the driver chips 133 drives a corresponding LEDA 132.

As illustrated in FIG. 5, the LEDA head 130 includes a plurality of LEDAs 132. Here, suppose that all the LED elements of all the LEDA 132 are turned on at the same time, such that a total amount of electric power is equal to a summation of electric power output of each LEDA 132. On the other hand, if the LED elements of the LEDA 132 are divided into certain number of groups and light emission is controlled by the groups, the electric power output can be reduced. Accordingly, such time division driving is adopted for the optical writing device 111 in an embodiment.

Figure 6A:
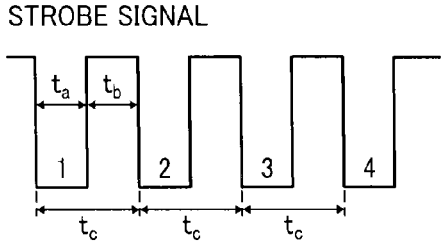
FIG. 6A illustrates time division control of the LED elements and exposure position on the photosensitive drum by way of a timing chart of a strobe signal according to an embodiment.
Figure 6B:
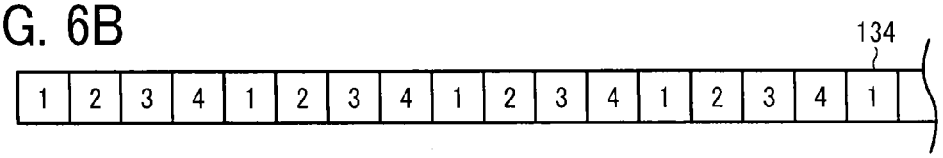
FIG. 6B illustrates time division control of the LED elements and exposure position on the photosensitive drum by way of an arrangement of the LED elements according to an embodiment.

Next, an example for controlling the LED elements with time division driving will be explained in accordance with an embodiment. FIGS. 6A-6B illustrate timing of the LED elements turned on/off, and their exposure position on the photosensitive drum 109. In FIG. 6B, the LED elements are classified into four groups, depicted as 1, 2, 3, and 4. Of course, four groups is an example, and the number of the groups can be less than 3, or it can be more than 5.

FIG. 6A shows a strobe signal for turning on/off the LED elements. In FIG. 6A, when the strobe signal is at a low level, the indicated corresponding LED elements are turned on, and when the strobe signal is at a high level, the corresponding LED elements are turned off. Moreover, FIG. 6A illustrates the strobe signals for one main scanning line.

As shown in FIG. 6A, a period of the strobe signal has duration tc The duration tc includes duration ta and duration tb. During the duration ta, the strobe signal is at low level and corresponding LED elements are turned on. On the other hand, during the duration tb, the strobe signal is at high level and corresponding LED elements are turned off. As explained above, all the LED elements are classified, in this embodiment, into four groups and the strobe signal periodically repeats tc for group 1, tc for group 2, tc for group 3, and tc for group 4. In FIG. 6A, the reference numerals 1 to 4 represents group 1 to group 4, respectively.

FIG. 6B depicts a schematic arrangement of the LED element 134. As explained above, the LED elements 134 are classified into 4 groups. In FIG. 6B, the reference numeral 1 to 4 represents group 1 to group 4, respectively and it is understood that the LED elements 134 are classified to group 1 to group 4.

When the strobe signal for group 1 is applied, all the LED elements 134 classified to group 1 are turned on simultaneously during the duration ta of the strobe signal 1. Other LED elements 134 classified to group 2 to group 4 are turned off. Then, all the LED elements 134 classified to group 1 are turned off simultaneously during the duration tb of the strobe signal 1. As a result, exposure positions LED elements 134 of group 1 are on the same position on sub-scanning direction, which is perpendicular to the main scanning direction. A similar process is performed for the other groups.

Figure 6C:
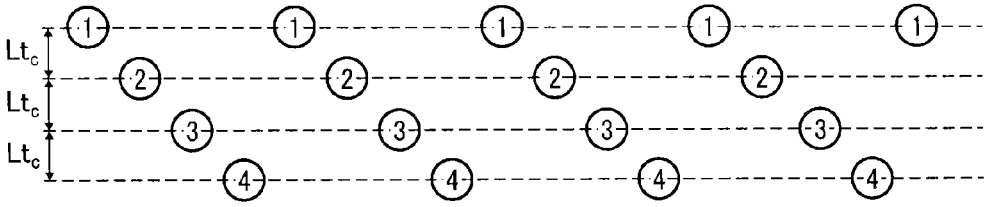
FIG. 6C illustrates time-controlled exposure position on the photosensitive drum according to an embodiment.

FIG. 6C illustrates exposure position of illumination on the photosensitive drum 109. Because the photosensitive drum 109 rotates, the exposure positions of each group are different on the sub-scanning direction, which is parallel to the paper conveyance direction. The distance Ltc between each position can be expressed as Ltc=Vd×tc, where the Vd is a line speed of the photosensitive drum 109. As a result, as shown in FIG. 6C, distortion of the exposure position occurs by such time division control. In other words, positions on the sub-scanning direction are shifted according to the time difference Ltc for every group. These LED elements 134 of group 1 to group 4 constitutes one main scanning line. In other words, one main scanning line is split to a plurality of sub-lines. The LED elements 134 of group 1 have the same exposure positions on the same sub-line. Similarly, The LED elements 134 of group 2 have the same exposure positions on the next sub-line.

Figure 7A:
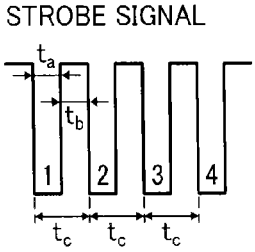
FIG. 7A illustrates another example of time division control of the LED elements and exposure position on the photosensitive drum by way of a timing chart of another strobe signal according to an embodiment.
Figure 7B:
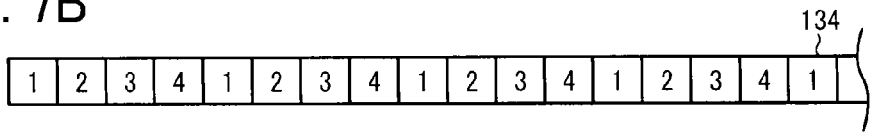
FIG. 7B illustrates time division control of the LED elements and exposure position on the photosensitive drum by way of an arrangement of the LED elements according to an embodiment.
Figure 7C:
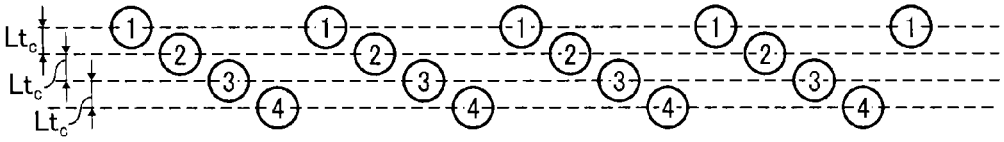
FIG. 7C illustrates time-controlled exposure position on the photosensitive drum according to an embodiment.

Next, another example to control the LED elements with the time division control will be explained with reference to FIGS. 7A-7C. In FIG. 7A, the period of the strobe signal is half compared to the period shown in FIG. 6A. FIG. 7B also represents an arrangement of the LED element 134. As a result, both the duration ta and the duration tb become half in FIG. 7A relative to FIG. 6A. FIG. 7C illustrates another example of exposure position of illumination on the photosensitive drum 109. In FIG. 7C, it is understood that because the signal period is shortened, the exposure positions are closer together as the drum rotates. Thus, the distortion of the exposure position is smaller than that shown in FIG. 6C. From these observations, it is understood that the shorter period of the strobe signal is preferable to reduce distortion.

Figure 8A:
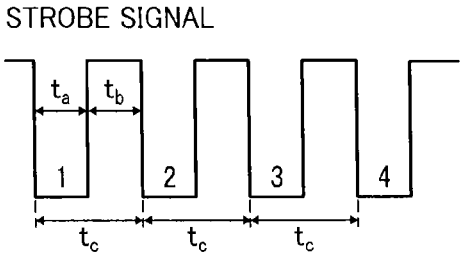
FIG. 8A illustrates still another example of time division control of the LED elements and exposure position on the photosensitive drum by way of a timing chart of a strobe signal according to an embodiment.
Figure 8B:
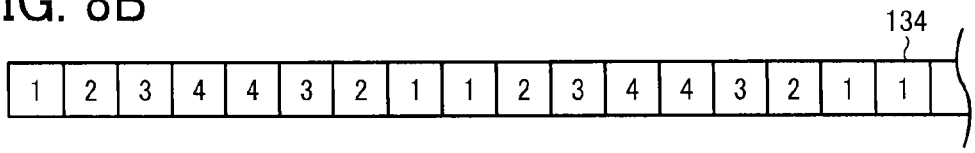
FIG. 8B illustrates time division control of the LED elements and exposure position on the photosensitive drum by way of an arrangement of the LED elements according to an embodiment.
Figure 8C:
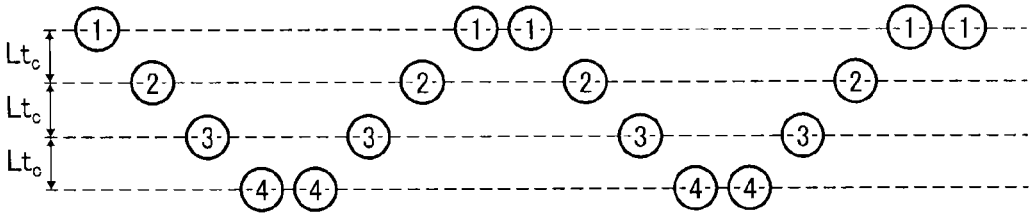
FIG. 8C illustrates time-controlled exposure position on the photosensitive drum according to an embodiment.

FIGS. 8A-8C illustrate still another example of the time division control. In FIG. 8B, the order of the emission for each group upon repetition of the signal shown in FIG. 8A is different than that depicted in FIG. 6B. In other words, groups 1 to 4 are sequentially turned on first, then groups 4 to 1 are sequentially turned on. Such order is repeated.

According to the control in FIG. 6B, for example, a large exposure position gap might occur between the exposure position of group 4 and the exposure position of group 1 on the photosensitive drum 109. On the contrary, such displacement can be minimized within Ltc with the LED elements according to the order of FIG. 8B.

Figure 9A:
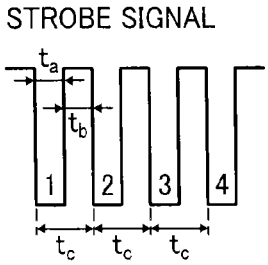
FIG. 9A illustrates still another example of time division control of the LED elements and exposure position on the photosensitive drum by way of a timing chart of a strobe signal according to an embodiment.
Figure 9B:
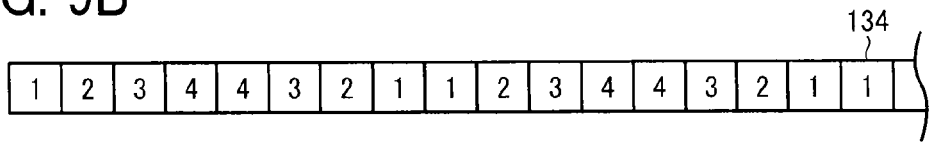
FIG. 9B illustrates time division control of the LED elements and exposure position on the photosensitive drum by way of an arrangement of the LED elements according to an embodiment.
Figure 9C:
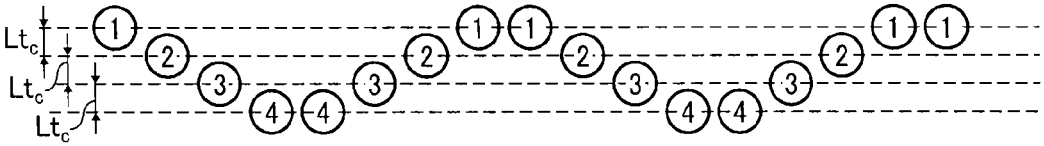
FIG. 9C illustrates time-controlled exposure position on the photosensitive drum according to an embodiment.

FIGS. 9A-9C illustrate still a further example of the time division control. The relationship between FIGS. 8A-8C and FIGS. 9A-9C essentially corresponds to that between FIGS. 6A-6C and FIGS. 7A-7C. In other words, in FIG. 9A, the period of the strobe signal is half compared to the period in FIG. 8A. In FIG. 9B, the order of the emission for each group upon repetition of the signal shown in FIG. 9A is different than that depicted in FIG. 6B, but the same as that depicted in FIG. 8B. In FIG. 9C, it is also understood that the distortion of the exposure position is smaller than that shown in FIG. 8C because the signal period is shortened and the exposure positions are closer together as the drum rotates.

Intrinsically, all exposure positions on the photosensitive drum 109 should be arraigned linear on the main scanning direction. An amount of such distortion is determined by the period of strobe signal. As explained above, the shorter the strobe period, the smaller the distortion. Accordingly, it is preferable to maintain the strobe period shorter when the time division control scheme is employed.

Figure 10A:
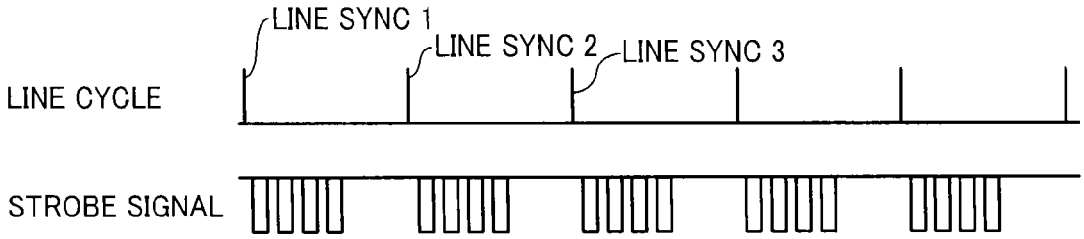
FIG. 10A illustrates an exemplary relationship between the strobe signals and line sync signals according to an embodiment.
Figure 10B:
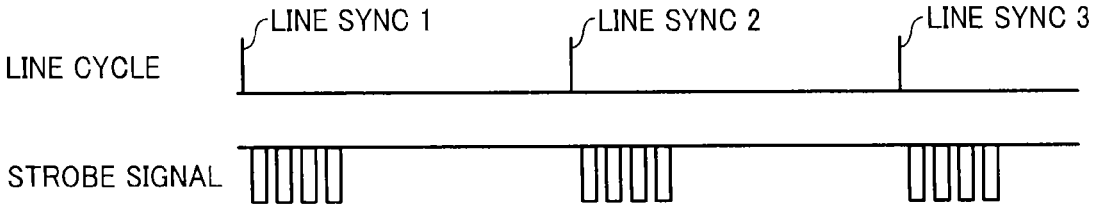
FIG. 10B illustrates another exemplary relationship between the strobe signals and line sync signals according to an embodiment.

Next, a relationship between the strobe signal and line sync signal will be explained with reference to FIGS. 10A-10B. FIGS. 10A-10B show timing charts, which illustrate a relationship between the strobe signal and the line sync signal. In FIGS. 10A-10B, four strobe signals are generated with regard to every line sync signal, because the LED elements are classified in four groups, consistent with an embodiment. The line sync signal is generated to determine a beginning of each main scanning line. The strobe signals are generated after the line sync signal for light emission control of the LEDA head 130 for every main scanning line. In other words, when a line sync signal is generated, light emission control of the LEDA head 130 for a main scanning line starts. Then, when the next line sync signal is generated, light emission control of the LEDA head 130 for the next main scanning line starts. A duration between a line sync signal and the next line sync signal is a line cycle. For every main scanning line, all strobe signals should be generated within the line cycle.

FIGS. 10A and 10B illustrate different examples showing the relationship between the strobe signals and line sync signals. In FIG. 10A, every strobe signal is generated within the period of each line cycle. In FIG. 10B, the line cycle period is twice the line cycle period of FIG. 10A. When the line speed of the photosensitive drum 109, in other words, its rotating speed, becomes half, the line cycle period should be doubled in order to form an image with the same resolution in the sub-scanning direction on the photosensitive drum 109. Also, when the line speed is maintained and the resolution in the sub-scanning direction becomes half, the line cycle period should be doubled.

As shown in FIG. 10B, a longer duration between repetitions of the strobe signal can be obtained when the line cycle becomes doubled. However, as explained with reference to FIGS. 6A-6C through 9A-9C, the longer the strobe period, the larger the manifested exposure position distortion. Accordingly, a short strobe period should be maintained regardless of the period of the line cycle.

In the above explanation, a relationship between the period of the strobe signal and the exposure position of a LEDA head 130 is illustrated with reference to FIGS. 6A-6C through 9A-9C. However, as earlier illustrated in FIGS. 3 and 4, the print engine 26 includes a plurality of image forming units 106, and there are a plurality of LEDA heads 130. Accordingly, exposure positions of each LEDA head of LEDA heads 130 are also to be considered for superimposing and forming the image. Preferably, the exposure positions of all LEDA heads 130 is the same in the image forming process.

Figure 11:
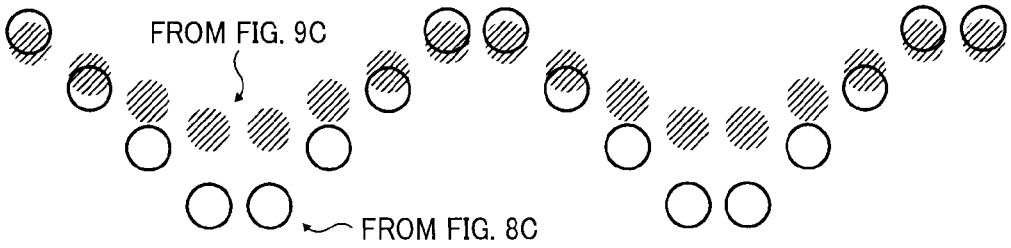
FIG. 11 illustrates exposure positions of two LEDA heads for the time-controlled exposure positions of FIGS. 8C and 9C, according to an embodiment.

FIG. 11 illustrates overlapping exposure positions of two LEDA heads 130 consistent with the illustrations shown in FIGS. 8C and 9C. Although the exposure positions of two LEDA heads 130 should preferably be the same, displacements might occur between the two LEDA heads 130 in a practical configuration. As a result, each of LEDA heads 130 form their image dots on different positions as illustrated in FIG. 11. FIG. 11 illustrates the image dot positions when the exposure positions from FIG. 8C and FIG. 9C are superimposed. In FIG. 11, the plain circles correspond to the exposure position from FIG. 8C, and the cross-sectional circles correspond to the exposure position from FIG. 9C.

Here, for the duration to shown in FIGS. 6A-6C through 9A-9C is determined so as to keep sufficient duration to vary the voltage of the surface of the photosensitive drum 109 and to form the electrostatic latent image. This duration may be different for each image forming unit 106, due to a material of the toner, illuminant characteristics of the LED elements of each of LEDA 132, and the like. Accordingly, if the duration time tb is set to the same value for all colors, it causes difference of the duration time tc between each colors.

As explained above, the distortion of the exposure positions on the main scanning direction is determined based on the duration tc in FIG. 11. When the strobe period tc for each image forming unit 106 is different from each other, each LEDA heads 130 forms their image dots on the different positions as illustrated in FIG. 11.

Figure 12A:
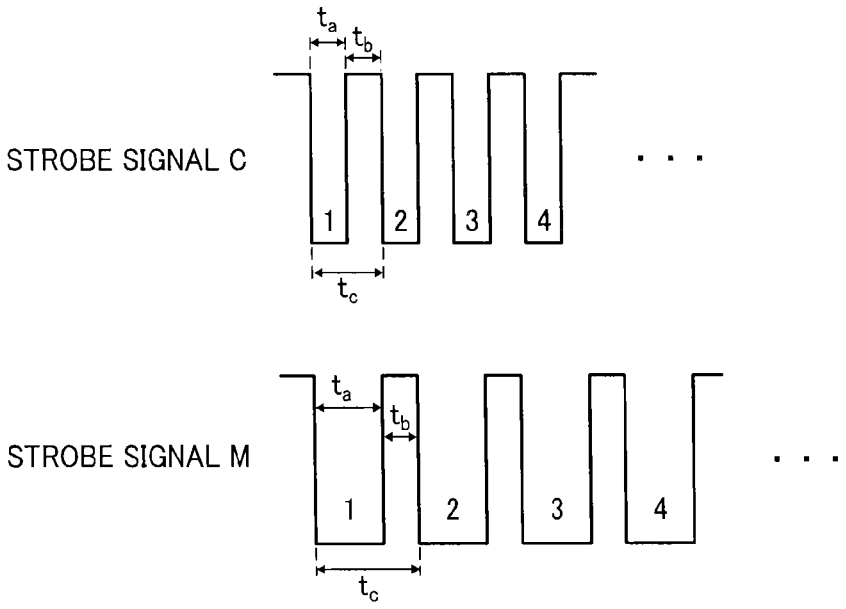
FIG. 12A illustrates an example of strobe signal adjustment according to an embodiment.
Figure 12B:
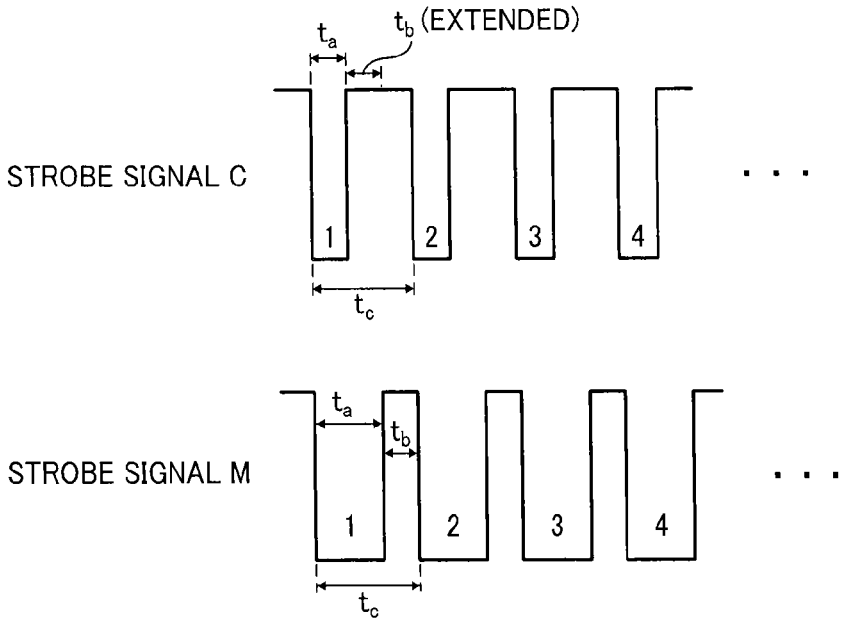
FIG. 12B illustrates another example of strobe signal adjustment according to an embodiment.

Consistent with an embodiment, all strobe periods tc are set equal by being adjusted to the longest strobe period tc among the plurality of image forming unit 106. Such adjustment process will be explained with reference to FIGS. 12A-12B. FIG. 12A illustrates a strobe period for image forming unit 106C and image forming unit 106M. In FIG. 12A, only image forming unit 106C and image forming unit 106M are described for simplicity. As shown in FIG. 12A, the duration ta for the image forming unit 106C is shorter than that of the image forming unit 106M. On the contrary, the durations tb for both image forming units 106C and 106M are the same. As a result, the sum of the durations ta and tb for image forming unit 106C differs from the sum of the durations ta and tb for image forming unit 106M. As explained earlier with reference to FIGS. 6A-6C through 9A-9C, the strobe period tc should be kept short. In other words, the sum of the duration ta and the duration tb should be set shorter for both image forming units 106C and 106M. However, it is difficult to shorten the duration ta, duration tb, and the strobe period tc of the image forming unit 106M more. Therefore, consistent with an embodiment, shorter strobe period is adjusted to be equal to the longer strobe period. In FIG. 12A, the strobe period tc of the image forming unit 106C (having the shorter strobe period tc) is adjusted to lengthen its period to match that of the longer strobe period tc of image forming unit 106M, by extending the duration tb of the image forming unit 106C to match the duration of tb of the image forming unit 106M. As a result, the strobe period of both image forming units 106C and 106M become equal, and distortion such as that shown with reference to FIG. 11 can be minimized.

Figure 13:
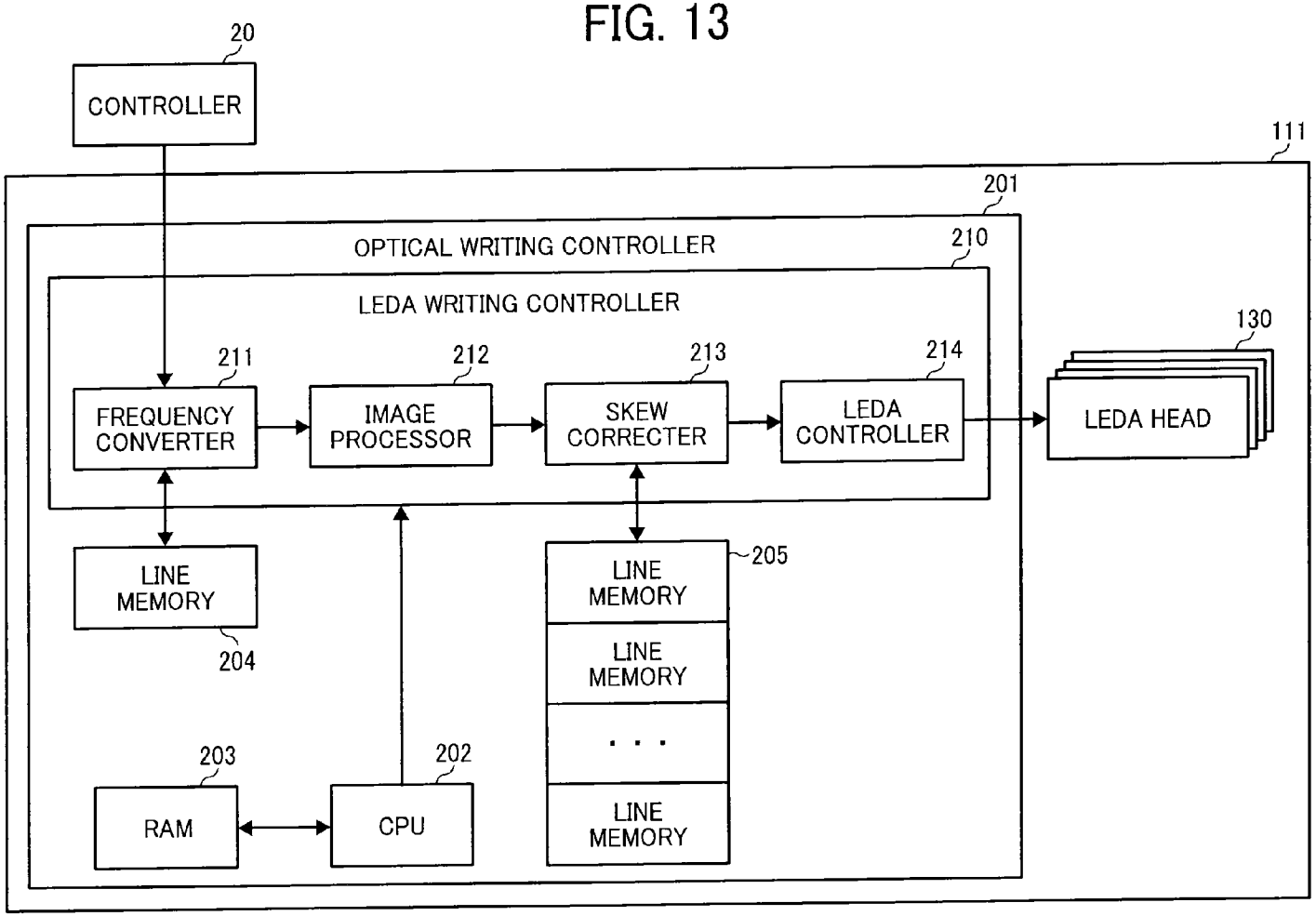
FIG. 13 is a diagram illustrating a configuration of the optical writing device according to an embodiment.

Next, a configuration of the optical writing device 111 according to an embodiment will be described with reference to FIG. 13. FIG. 13 is a block diagram illustrating a functional configuration of the optical writing device 111. FIG. 13 also illustrates the connection between the optical writing device 111 and the controller 20. As illustrated in FIG. 13, the optical writing device 111 is included in the print engine 26 described earlier and shown in FIG. 2.

As illustrated in FIG. 13, the optical writing device 111 receives control signals from the controller 20. The optical writing device 111 includes an optical writing controller 201, which has a CPU 202 that controls the optical writing device 111, a RAM 203 as a main memory, line memories 204 and 205, and a LEDA writing controller 210. The LEDA writing controller 210 includes a frequency converter 211, an image processor 212, a skew corrector 213, and a LEDA controller 214.

Similar to the explanation of FIG. 1, programs stored in a recording media may be stored in the RAM 203, and the CPU 202 performs computations in accordance with these programs to configure a software control unit. A combination of the software control unit configured in this manner and hardware operates to realize the functions of the optical writing controller 201.

Here, a configuration of the optical writing controller 201 will be explained. As explained in FIG. 3 and FIG. 4, the LEDA print head 130 are disposed to each of the photoconductive drums 109K, 109M, 109C, and 109K. Therefore, the optical writing controller 201 has a function to perform writing control to every LEDA print heads.

The LEDA writing controller 210 controls emission of the LEDA heads 130 based on the image information provided from the controller 20. The LEDA writing controller 210 may be realized by hardware such as circuitry provided on a semiconductor chip, and it may be controlled by the CPU 202. The frequency converter 211 converts frequency of the image information provided from the controller 20 to the suitable frequency of the LEDA writing controller 210. The frequency converter 211 temporarily stores the image information in a line memory 204, and reads out the image information in accordance with the operation clock of the LEDA writing controller 210. The frequency converter 211 also functions as an image information acquiring unit that receives image information provided from the controller 20.

Afterward, the image processor 212 provides image processing, e.g., converts an image size, trimming the image, and adds internal patterns to the image to the drawing information received from the frequency converter 211. The image processor 212 also controls the timing to provide drawing information to the skew corrector 213, thereby performing misalignment correction in accordance with a unit of input resolution. This misalignment correction is performed in accordance with a setting that is designated in a register 301 of the LEDA writing controller 210.

Furthermore, the image processor 212 converts the image information, provided from the frequency converter 211 as multi-gradation information, into bi-gradation data. Finally, the image processor 212 performs a binarization process on the bi-gradation data to generate the pixel information to drive the LEDA head 130. Consistent with an embodiment, the image processor 212 generates the pixel information by referring to a resolution conversion table (not shown), which is predetermined and stored in the optical writing controller 201, based on 4-bit image data from the frequency converter 211. Here, although the format of the image data is explained as being 4-bit image data, the format is not necessarily so limited. For example, the image data may be 8-bit data, or it may be 2-bit data.

Then, the skew corrector 213 corrects skew that occurs due to various reasons such as misalignment between the LEDA heads 130 and the photosensitive drums 109. Parameters used for the skew corrector 213 are stored in the optical writing controller 201 and are set for the skew corrector 213 by the CPU 202. The skew corrector 213 shifts the lines to be read out from the line memory 205. In the line memory 205, there is stored a plurality of pixel information, which corresponds to a plurality of main scanning lines. The shifting operation of skew corrector 213 is performed based on positional relationship between the LED print head 130 and the photosensitive element 109 according to the result of the previous distortion detection. For example, suppose that when the pixel information for first main scanning line is read out from the line memory 205, the skew corrector 213 shifts, at a predetermined position on the main scanning line, to read out the pixel data for a second main scanning line. According to this operation, proper electrostatic image can be formed on the photosensitive element 109.

The LEDA controller 214 controls light emission of LED elements of the LEDA head 130 based on the pixel information from the skew corrector 213. In other words, the LEDA controller 214 may be a light source controller. The LEDA controller 214 adjusts the strobe period tc for every LEDA 132 with above-mentioned manner. The LEDA controller 214, consistent with an embodiment, determines the turn on timing for each of the LED elements of the LEDA head 130. Here, the LEDA controller 214 determines the turn on timing of each LED so that the illumination period of each head 130 does not conflict. This control will be explained later.

Figure 14:
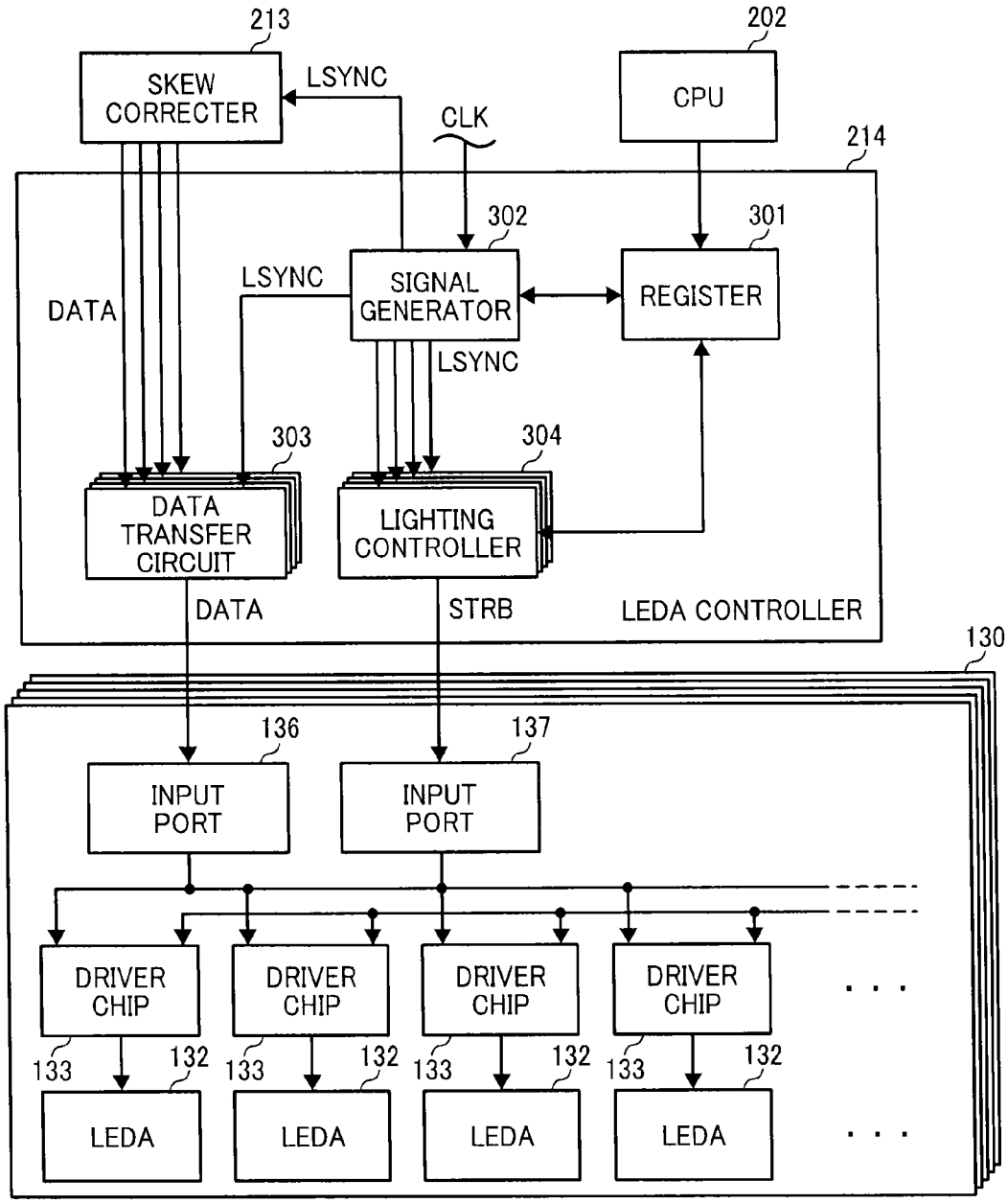
FIG. 14 is a diagram illustrating a detailed configuration of the LEDA controller and an LEDA head according to an embodiment.

Next, a detailed configuration of the LEDA controller 214 and the LEDA head 130 according to an embodiment will be described with reference to FIG. 14. FIG. 14 illustrates a hardware configuration of the LEDA controller 214 and a hardware configuration of the LEDA head 130. As illustrated in FIG. 14, the LEDA controller 214 includes a register 301, a signal generator 302, a data transfer circuit 303, and a lighting controller 304.

The register 301 stores parameters set by the CPU 202. The signal generator 302 generates the line sync signal LSYNC (see, e.g., FIGS. 10A-10B), which indicates an illumination period for every main scanning line of the LEDA 132. The line sync signal is generated based on reference clock CLK provided from outside of the signal generator 302. The LSYNC determines the period of each line cycle. Here, the signal generator 302 generates and outputs the LSYNC for each of the image forming units 106Y, 106M, 106C, and 106K.

The data transfer circuit 303 transfers the pixel information DATA, which is provided by the skew corrector 213, to the LEDA head 130. This transfer process is performed in synchronization with the LSYNC that is provided by the signal generator 302. The lighting controller 304 generates and outputs the strobe signal STRB to the LEDA heads 130, based on the LSYNC signal provided from the signal generator 302. This strobe signal STRB is to control the light emission of the LED elements of the LEDA heads 130.

Each of the LEDA heads 130 includes an input port 136 to accept the pixel information DATA and an input port 137 to accept the strobe signal STRB. The pixel information DATA and the strobe signal STRB are provided to each of the driver chips 133.

Figure 15:
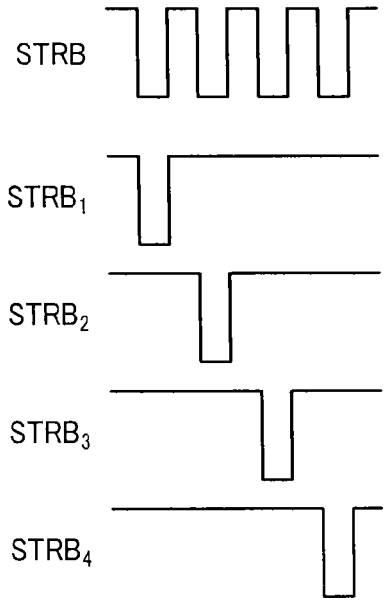
FIG. 15 illustrates a timing of the strobe signals according to an embodiment.

Next, timing of the strobe signal STRB output from the lighting controller 304 and respective strobe signals STRB1 to STRB4 provided to each lighting group is described with reference to FIG. 15. FIG. 15 is a timing chart illustrating a relationship between the strobe signal STRB and the strobe signals STRB1 to STRB4. Here, the LED elements which belong group 1 are controlled by the strobe signal STRB1, the LED elements which belong group 2 are controlled by the strobe signal STRB2, the LED elements which belong group 3 are controlled by the strobe signal STRB3, and the LED elements which belong group 4 are controlled by the strobe signal STRB4.

As illustrated in FIG. 15, the lighting controller 304 outputs the strobe signal STRB. The strobe signal STRB is a combination of all strobe signals STRB1 to STRB4. Upon receiving the strobe signal STRB, the input port 137 (shown in FIG. 14) distributes the strobe signals STRB1 to STRB4, respectively corresponding to group 1 to group 4 included in the strobe signal STRB. These strobe signals STRB1 to STRB4 are provided to each driver chip 133. The driver chips 133 drives the LED elements in the LEDA 132 based on the strobe signals STRB1 to STRB4.

The pixel information DATA provided from the data transfer circuit 303 is provided to the input port 136 (shown in FIG. 14), and is then distributed to the corresponding driver chip 133. The input port 136 includes, for example, a shift register for converting pixel information having serial format to pixel information having parallel format. The driver chip 133 determines light emission of the LED elements of the LEDA 132 based on the pixel information DATA provided from the input port 136. The light emission of the LED elements is performed in accordance with the strobe signal STRB.

As explained above, the optical writing device 111, more specifically the lighting controller 304 provides the strobe signal STRB. In other words, the lighting controller 304 determines the strobe period tc. The lighting controller 304 determines the strobe period tc based on the parameters stored in the register 301 and outputs the strobe signal STRB. The CPU 202 sets the necessary parameters in the register 301. In other words, the CPU 202 functions as a determination unit that determines illumination period. Such a determination process by CPU 202 will be described next with reference to FIG. 16.

Figure 16:
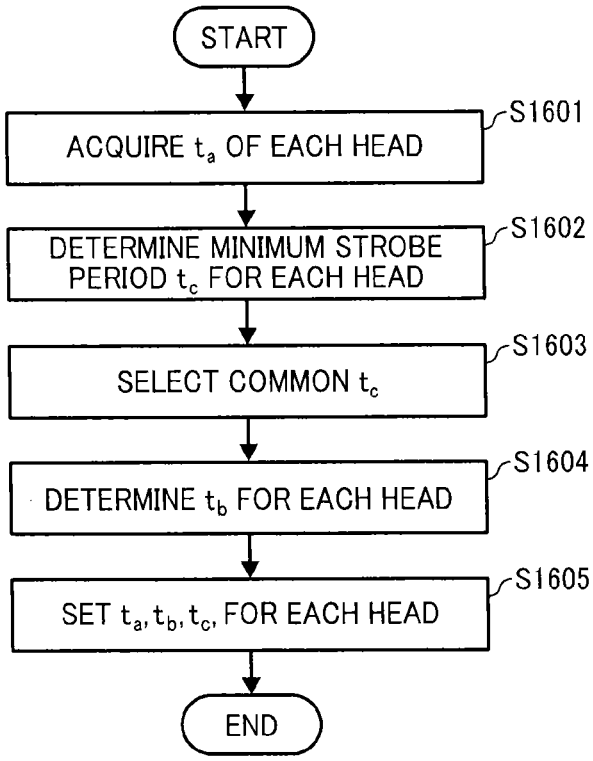
FIG. 16 is a flowchart illustrating an illumination determination process according to an embodiment.

Consistent with an embodiment, an exemplary determination process will be explained with reference to FIG. 16. FIG. 16 is a flowchart illustrating a determination process of strobe period tc performed by the CPU 202.

As shown in FIG. 16, the CPU 202 first acquires duration ta (turn on period) of each LEDA head 130 (step S1601). As explained above, the duration ta is determined according to characteristics of the material of the toner, illuminance characteristics of the LED elements of each LEDA 132, and the like. The CPU 202 determines the duration ta in accordance with these characteristics, for each LEDA 132.

Then, the CPU 202 determines a minimum strobe period tc for each LEDA head 130 (step S1602). The minimum strobe period tc can be determined from the duration ta and the minimum duration tb. Here, the minimum duration tb can be a predetermined value or it can be determined from various characteristics similar to the determination of duration ta.

After determining the minimum strobe period tc for each LEDA 132, the CPU 202 then selects the longest value among the plurality of minimum strobe periods tc as a common tc (step S1603). The selected value is used as a common strobe period tc for all the LEDA 132. The CPU 202 determines a duration tb for each LEDA 132 (step S1604). These durations tb may be determined by subtracting the ta determined for each LEDA 132 from the common strobe period tc.

Finally, the CPU 202 sets the duration ta, the duration tb, and the strobe period tc, for each LEDA 132 to the register 301 in the LEDA controller 214 (step S1605). Thus, the determination process performed by the CPU 202 is achieved. After the setting of the duration ta, the duration tb, and the strobe period tc for each LEDA 132, the duration ta that is suitable for each LEDA 132 can be maintained at each LEDA head 130. Moreover, the common strobe period, which is the longest value among each strobe period tc for each LEDA 132, is used to perform the time division control.

As a result, the strobe period tc for each LEDA 132 becomes equal by employing the common tc. Accordingly, the position distortion between each of image forming units 106, as described with reference to FIG. 11, can be eliminated Furthermore, the common strobe period tc may still be kept short, as explained earlier with reference to FIGS. 6A-6C through 9A-9C. This shorter common strobe period can reduce the distortion on a main scanning line even though the time division control scheme is employed.

According to the optical writing device of an embodiment, the LED elements of the LEDA head 130 are classified into a plurality of groups, and the groups are subject to light emission control. The light emission control is performed in a manner consistent with the above-described time division control, and the turn on periods of each of the groups do not conflict. This can reduce the position distortion between the images formed by the image forming units, such that an amount of the distortion at any of the image forming units does not differ that of another of the image forming units.

Further, as explained earlier, the number of the image forming units should not be limited to four. For example, the disclosed embodiments may be adapted for monochrome printing. In such a case, only the duration ta for the image forming unit 106 K would be used for determining the strobe period tc. Similarly, when part of the image forming units are used for image forming, this embodiment can be adopted.

On the contrary, even though in the monochrome printing mode, or when the part of the image forming units are used for image forming, duration ta of all image forming units (CMYK) can be aquired and used. By aquiring all duration ta for all image forming unit in those situations, image quality is maintained and the same image quality can be adjusted to the quality of full-color printing.

As explained above, the duration tc of a plurality of light sources each having different duration ta, should be adjusted. This can be implemented for the LEDA print head for one color, which has a plurality of LED chips. As shown in FIG. 5, for example, a LED print head 130 includes a plurality of LEDA 132. Each LEDA 132 has different characteristics because of individual differences therein. In addition, this can be implemented for the different LEDA print heads for different colors. Consistent with the disclosed embodiments, this can be implemented not only to adjust duration tc for the LEDA print head for one color, but also to adjust duration tc for the LEDA print heads for a plurality of colors.

Alternatively, to acquire duration ta for every LED print head 130, it is also possible to adjust the duration tc for the LEDA 132. In this situation, the CPU 202 may acquire duration ta for every LEDA 132 or instead acquire duration ta for every LEDA print head 130 in step S1601. Then, the CPU202 determines minimum strobe period tc for each LEDA 132 at step S1602. Finally, the CPU202 selects the longest value among the plurality of minimum strobe period tc at step S1603.

What is claimed is:

1. An optical writing control device that controls light emission of a plurality of exposure heads to form an electrostatic latent image on multiple photosensitive elements, each of the exposure heads including a plurality of light emitting elements disposed in a line and classified into a plurality of groups, comprising:

frequency converter circuitry configured to acquire image information to be formed as the electrostatic latent image; and a head controller configured to control the plurality of exposure heads based on pixel information generated from the acquired image information, wherein the head controller is further configured to:

control the light emission of the plurality of exposure heads by:

classifying the light emitting elements into the plurality of groups, and shifting a timing of light emission from one group of the plurality of groups to a next group of the plurality of groups, and determine a common illuminating period for the light emitting elements of the plurality of exposure heads based on the shifted timing of light emission among the plurality of groups.

2. The optical writing control device according to claim 1, wherein the head controller includes a determination circuit configured to:

determine the common illuminating period by acquiring each illuminating period for the light emitting elements of the exposure heads, and determine the common illuminating period as a longest illuminating period value acquired among minimum illuminating period values acquired for said each illuminating period.

3. The optical writing control device according to claim 2, wherein the plurality of exposure heads correspond to a main scanning line.

4. The optical writing control device according to claim 3, wherein the plurality of exposure heads are configured to form a full-color image.

5. An optical writing control method for controlling light emission of a plurality of exposure heads to form an electrostatic latent image on multiple photosensitive elements, each of the exposure heads including a plurality of light emitting elements disposed in a main scanning line and classified into a plurality of groups, the method comprising:

acquiring, using frequency converter circuitry, image information to be formed as the electrostatic latent image; and controlling the plurality of exposure heads based on pixel information generated from the acquired image information, by controlling the light emitting elements in every group of the plurality of groups in turn, thereby exposing the multiple photosensitive elements in a sub-scanning line of the main scanning line, and by determining a common illuminating period for the light emitting elements of the plurality of exposure heads based on a shifted timing of light emission among the plurality of groups.

6. The optical writing control method according to claim 5, wherein the determining further comprises:

determining the common illuminating period by acquiring each illuminating period for the light emitting elements of the exposure heads, and determining the common illuminating period as a longest illuminating period value acquired among minimum illuminating period values acquired for said each illuminating period.

7. The optical writing control method according to claim 5, wherein the plurality of exposure heads correspond to the main scanning line.

8. The optical writing control method according to claim 5, further comprising forming a full-color image from the plurality of exposure heads illuminated during the common illuminating period.

* * * * *